US006727932B2

(12) United States Patent
Enomoto et al.

(10) Patent No.: US 6,727,932 B2
(45) Date of Patent: Apr. 27, 2004

(54) PRINTER AND PRINTING METHOD

(75) Inventors: Hisashi Enomoto, Saitama (JP); Kouichi Hirasawa, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/455,421

(22) Filed: Jun. 6, 2003

(65) Prior Publication Data

US 2003/0227535 A1 Dec. 11, 2003

(30) Foreign Application Priority Data

Jun. 7, 2002 (JP) ..... 2002-167939

(51) Int. Cl.[7] ..... B41J 2/35; B41J 2/355; B41J 2/36

(52) U.S. Cl. ..... 347/188; 400/120.09

(58) Field of Search ..... 347/188, 211; 400/120.09

(56) References Cited

U.S. PATENT DOCUMENTS 6,496,211 B2 * 12/2002 Katsuma ..... 347/188

FOREIGN PATENT DOCUMENTS

JP 09-272217 A 10/1997
JP 2002205420 * 7/2002 ..... B41J/2/35

* cited by examiner

*Primary Examiner*—Huan Tran
(74) *Attorney, Agent, or Firm*—Sughrue Mion, PLLC

(57) ABSTRACT

A lateral edge of a color thermosensitive recording paper in the main scan direction is detected. An edge heating element closest to the lateral edge is specified. The distance W between the edge heating element and the lateral edge of the color thermosensitive recording paper is detected. The proportion of the distance W to the width Wt of the heating element is calculated. Recording density of the edge heating element is lowered according to the proportion. The boundary between the edge of the recording paper and the print image is blurred.

12 Claims, 9 Drawing Sheets

PRINTER AND PRINTING METHOD

BACKGROUND OF THE INVENTION

1. Field of the Invention

The present invention relates to a printer and a printing method, in particular a printer and a printing method that make a margin-free print.

2. Explanations of the Prior Arts

Due to the wide usage of digital still camera, demand for color printing of the photographed image is on the increase. A color thermosensitive printer is used for color printing. The color thermosensitive printer has a thermal head to print a full-color image to a color thermosensitive recording paper with yellow, magenta, and cyan thermosensitive coloring layers on a substrate. The color thermosensitive printer heats a heating element array of the thermal head, so that the three thermosensitive coloring layers successively develop their respective colors, to form a full-color image.

It is preferable to have a marginless printing in terms of print efficiency and print quality. In order to make a marginless print, the heating element array must be wider than the color thermosensitive recording paper to record the lateral edge of the color thermosensitive recording paper without fail. When the heating element that does not touch the color thermosensitive recording paper is heated, however, so-called "wasted heating" happens to exceedingly increase the temperature of such heating element. Then the life-time of the heating element is shortened.

In order to prevent the wasted heating, JPA No. 9-272217 discloses a printer having regulation means that corrects the position of a color thermosensitive paper tilted in the width direction. Further, the printer applies inspection light to a lateral edge portion of the color thermosensitive recording paper. A CCD line sensor detects the lateral edge by monitoring inspection light reflected at the color thermosensitive recording paper.

In terms of cost and space, some printers do not have regulation means. Such printer may cause tilt of the color thermosensitive recording paper. As shown in FIG. 9, when a color thermosensitive recording paper 70 is inclined to inclined to the direction of arrangement of a heating element 73 against the width direction, the jaggy areas 72 are appeared on both lateral edge portions of a print image 71 (shown by diagonal line). These jaggy areas 72 lowers image quality.

SUMMARY OF THE INVENTION

An object of the present invention is to provide a printer and a printing method that improves image quality by decreasing jaggy effect.

To attain the above object, the printer of the present invention has a record control section to control an edge recording elements of a recording head to decrease the recording density at the lateral edge of a recording paper in a main scan direction. A detecting section specifies an edge recording element that is closest to the lateral edge position among the recording elements with the whole pixel in the recording paper.

In the preferred embodiment, the printer has a CCD line sensor on which plural pixels are arranged in the main scan direction. The pixels of the CCD line sensor and the recording elements are respectively arranged at an equal pitch in the main scan direction. The detecting section detects the lateral edge position by the change of output signal levels from the pixels. The lateral edge position is stored into the memory as lateral edge position data.

The detecting section interpolates the output signal levels from the pixels to obtain an output level curve with respect to said main scan direction. Each time the recording paper is conveyed by one line, the detecting section decides the lateral edge position in which the output level curve takes a set value.

The record control section calculates a control value that is the proportion of the distance between the lateral edge position and the edge recording element in the main scan direction to the interval of the adjacent recording elements. Recording density of the edge pixel is adjusted in accordance with the control value. In order to determine the recording density of the edge pixel, the control value is multiplied by density of the image corresponding to the edge pixel.

As recording density is lowered according to the proportion, the boundary between the edge of the recording paper and the print image is blurred to improve image quality.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
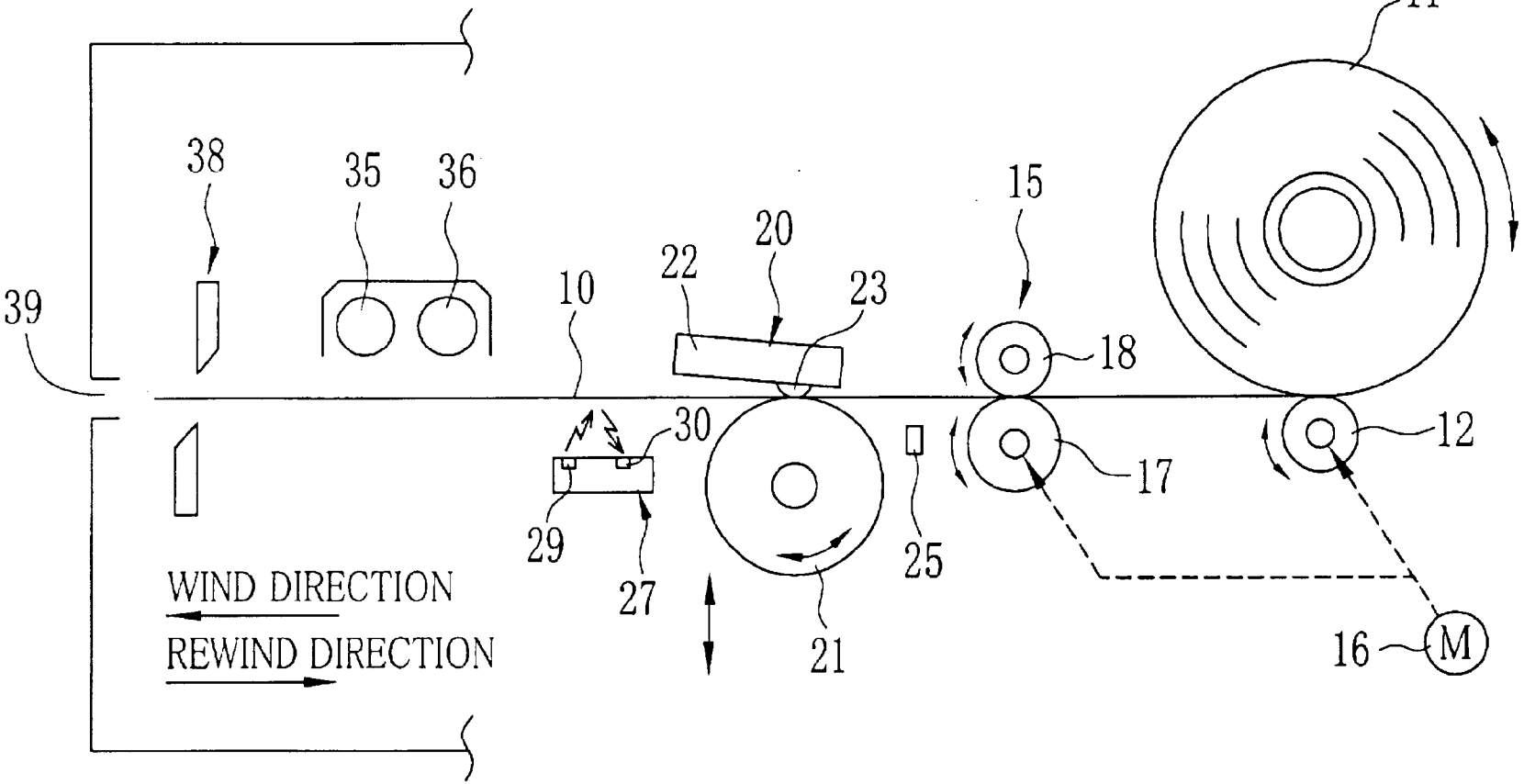
FIG. 1 is a schematic view illustrating a color thermosensitive printer.

FIG. 1 shows a color thermosensitive printer in which the present invention is applied. A color thermosensitive recording paper 10 as a recording medium is rolled to be a recording paper roll 11, which is set in the color thermosensitive printer. A paper-supply roller 12 contacts the outer surface of the recording paper roll 11 and rotates it to convey the color thermosensitive recording paper 10 back and forth. The color thermosensitive recording paper 10 has a cyan thermosensitive coloring layer, a magenta thermosensitive coloring layer, a yellow thermosensitive coloring layer, and a transparent protective layer that are laid on a substrate in the order listed. Thermosensitivity of these thermosensitive coloring layers are different such that each color image is selectively recorded in the corresponding thermosensitive coloring layer. The yellow thermosensitive coloring layer, the uppermost layer, has the highest thermosensitivity, and develops yellow when small thermal energy is applied. Meanwhile, the cyan thermosensitive coloring layer has the lowest thermosensitivy, so that large thermal energy is needed to color the cyan thermosensitive coloring layer. The yellow thermosensitive coloring layer loses its coloring ability when near ultraviolet rays with a wavelength of 420 nm is emitted. The magenta thermosensitive coloring layer has thermosensitivity between those of the yellow thermosensitive coloring layer and the cyan thermosensitive coloring layer, and loses its coloring ability when ultraviolet rays with a wavelength of 365 nm is emitted.

In FIG. 1, a convey roller pairs 15 is provided in the downstream side of the recording paper roll 11 with respect to the wind direction. The convey roller pairs 15 consists of a capstan roller 17 and a pinch roller 18 that nip the color thermosensitive recording paper 10. When a convey motor 16 is driven, the convey roller pairs 15 is rotated to convey the color thermosensitive recording paper 10 in a wind and rewind direction shown in the drawing.

A thermal head 20 and a platen roller 21 are disposed on the downstream side of the convey roller pairs 15 so as to nip the conveyance path of the color thermosensitive recording paper 10. The thermal head 20 has a head plate 22 of high heat conductivity metal. Plural heating elements are arranged under the head plate 22 at a predetermined pitch in a line along a main scan direction perpendicular to the wind direction. A heating element array 23 is longer than the width of the color thermosensitive recording paper 10 in order to print both lateral edge portions of the color thermosensitive recording paper 10 (See FIG. 2). When the color thermosensitive recording paper 10 is conveyed in the rewind direction by the convey roller pairs 15, the thermal head 20 heats each heating element of the heating element array 23 to develop color pixel by pixel in each thermosensitive coloring layer.

The platen roller 21 below the thermal head 20 is movable up and down, and biased by a spring (not shown) at a nip position to press the heating element array 23. At the nip position, the platen roller 21 is rotated in accordance with the conveyance of the color thermosensitive recording paper 10 for the purpose of pressing the color thermosensitive recording paper 10 against the heating element array 23.

Due to the difference in thermosensitivity of the yellow, magenta, and cyan thermosensitive cloring layers, the drive time of the heating element is different according to the color to record. Therefore, the one line printing period for printing a single line satisfies the relationship; yellow printing<magenta printing<cyan printing. A leading edge sensor 25 is between the convey roller pairs 15 and the platen roller 21 to detect the leading edge of the color thermosensitive recording paper 10 upon paper supply. A photo interrupter having a light projector and a light detector is used as the leading edge sensor 25. The light projector emits light to the color thermosensitive recording paper 10. The light detector detects light reflected at the color thermosensitive recording paper 10 to detect the leading edge.

Figure 2:
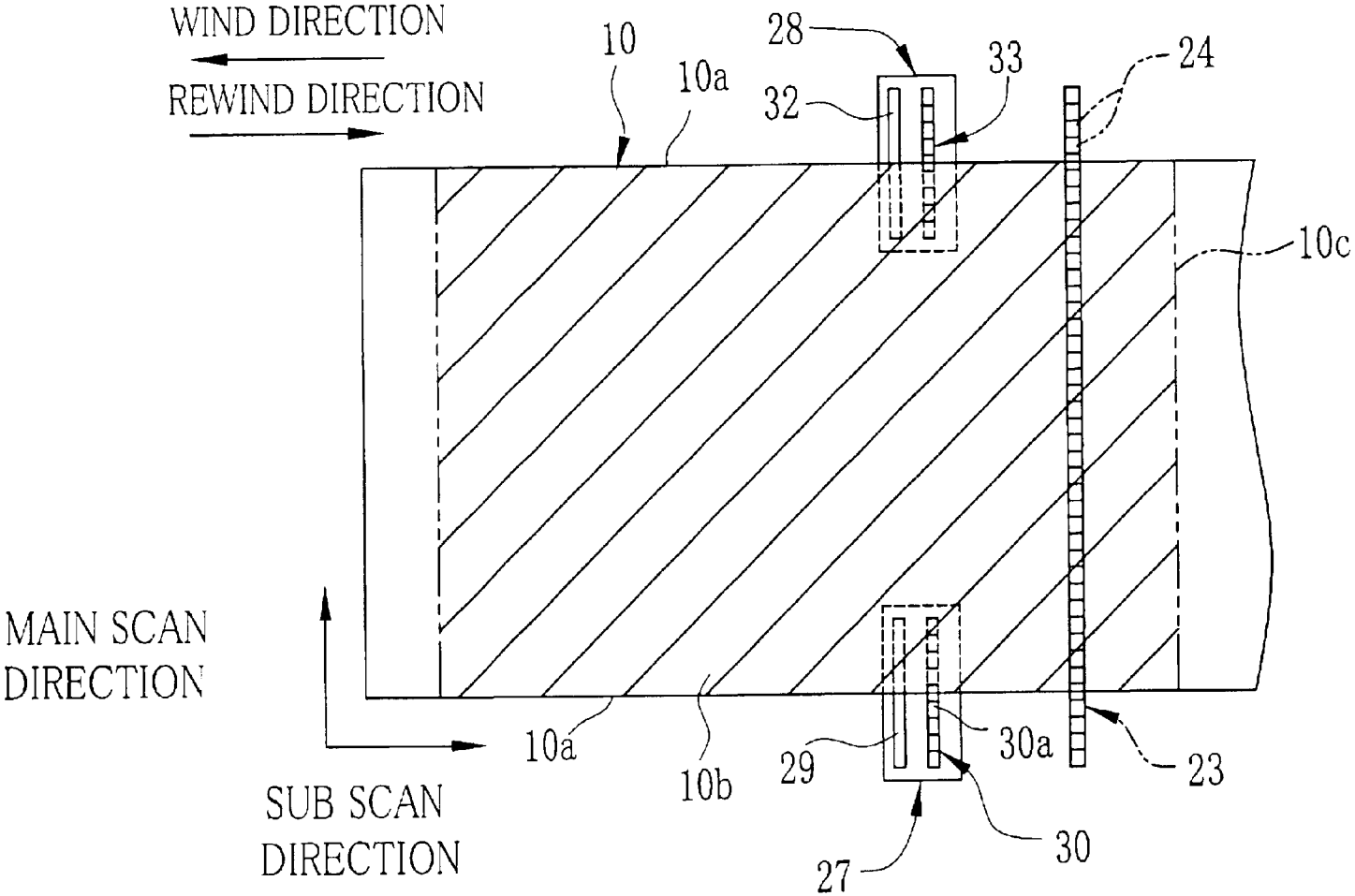
FIG. 2 is a top plan view illustrating a heating element array and lateral edge sensors.

A lateral edge sensor 27 to detect the lateral edge of the color thermosensitive recording paper 10 is arranged downside of the conveyance path and on the downstream side of the thermal head 20 in a wind direction. As shown in FIG. 2, the lateral edge sensor 27 has a linear LED 29 and a CCD line sensor 30. The LED 29 projects inspection light to a lateral edge portion of the color thermosensitive recording paper 10. The CCD line sensor 30 has plural pixels 30*a* arranged in the main scan direction. Output signal level of a pixel is high when the pixel detects inspection light reflected at the color thermosensitive recording paper 10. On the other hand, output signal level is low when the pixel does not detect reflected light. Therefore, it is possible to detect the lateral edge 10*a* of the color thermosensitive recording paper 10 by comparing the output signal levels from the pixels of the CCD line sensor 30.

The pixels 30*a* of the CCD line sensor 30 and the heating elements 24 of the heating element array 23 are respectively arranged at an equal pitch in the main scan direction. Therefore, the lateral edge 10*a* of the color thermosensitive recording paper 10 can be detected by a unit of heating element. Note that plural small elements of LED can be arranged in the main scan direction, although the LED 29 extended in the main scan direction is used in the above embodiment. A LED 32 and a CCD line sensor 33 of the lateral edge sensor 28 are same as those of the lateral edge sensor 27.

In FIG. 1, a yellow fixation lamp 35 and a magenta fixation lamp 36 that consist of a fixing light device are disposed on the downstream side of the thermal head 20 in the wind direction. The yellow fixation lamp 35 applies near ultraviolet rays having a wavelength peak at around 420 nm to fix the yellow thermosensitive coloring layer of the thermosensitive recording paper 10. The magenta fixation lamp 36 applies near ultraviolet rays having a wavelength peak at around 365 nm to fix the magenta thermosensitive coloring layer of the color thermosensitive recording paper 10. A cutter 38 is disposed on the downstream side of the yellow fixation lamp 35 in the wind direction. The cutter 38 cuts the color thermosensitive recording paper 10 by each recording area to make a cut sheet. A paper outlet 39, disposed on the downstream side from the cutter 38, ejects the cut sheet outside the color thermosensitive printer.

Figure 3:
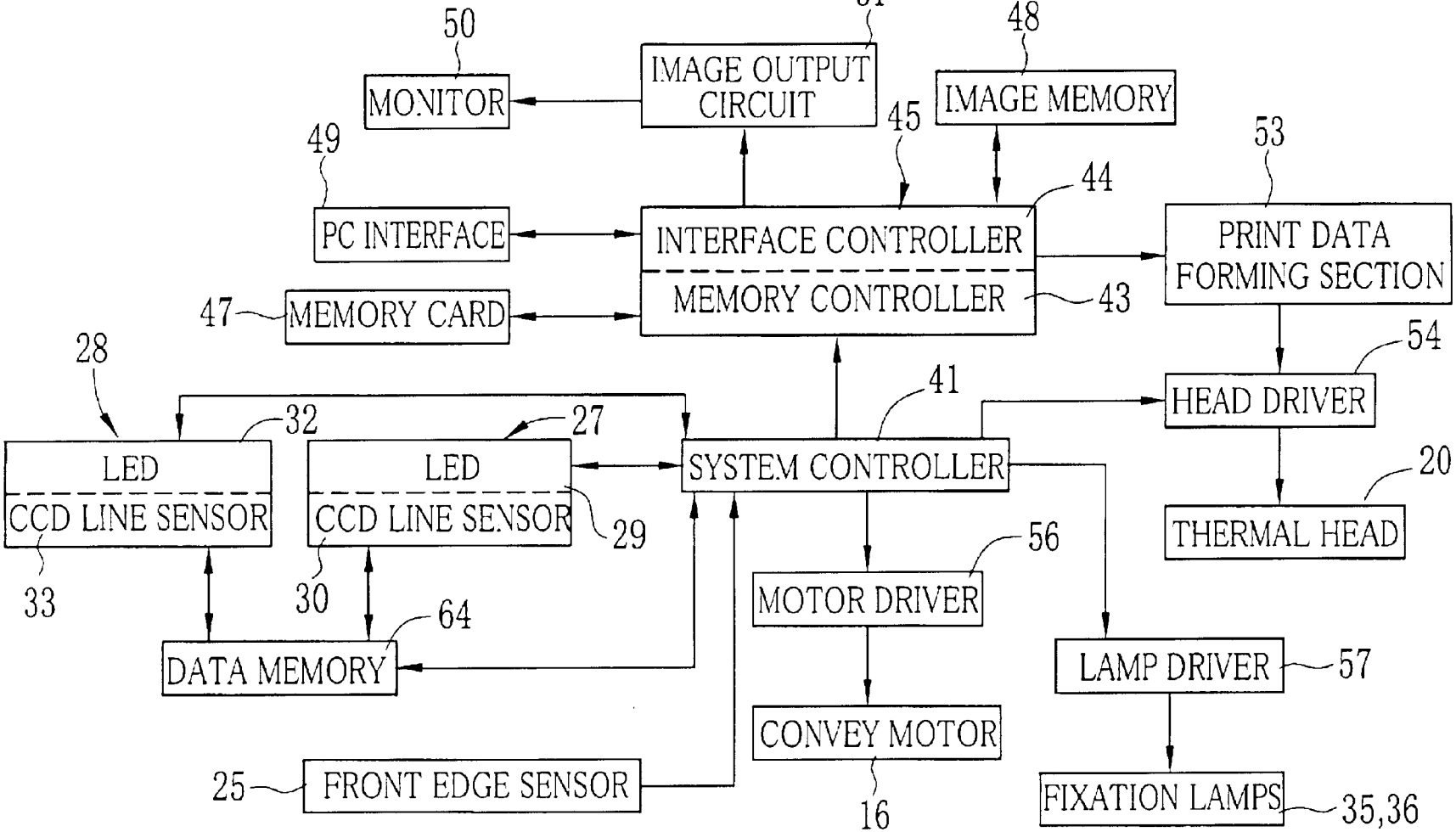
FIG. 3 is a block diagram illustrating structure of the color thermosensitive printer.

As shown in FIG. 3, the color thermosensitive printer of the present embodiment is integrally controlled by a system controller 41, which consists of a CPU, a program ROM, a work RAM, and so forth, for instance. In order to control the whole printer, the CPU controls each section of the color thermosensitive printer in accordance with the control program stored in the program ROM and stores data temporarily in the work RAM. The system controller 41 is connected to an IC 45 in which a memory controller 43 and an interface controller 44 are loaded. The memory controller 43 controls a memory card 47 inserted into a memory card slot provided in outer surface of the color thermosensitive printer and an image memory 48, for reading and writing image data. The interface controller 44 controls a PC interface 49 to connect with a personal computer and a digital camera, and an image output circuit 51 to output an image to a monitor 50. For instance, in case image data stored in the memory card 47 is displayed on the monitor 50, image data is read out by the memory controller 43, and inputted to the image output circuit 51 by the interface controller 44. The image output circuit 51 converts image data of RGB format to a composit signal of NTSC format, then outputs the composit signal to the monitor 50.

In the image printing, image data in the memory card 47 is read out by the memory controller 43 and stored in the image memory 48. The memory controller 43 reads image data in the image memory 48, and sends it to a print data forming section 53. In the print data forming section 53, image data of RGB format is converted to print data of YMC format. Print data of each color is inputted to a head driver 54 line by line. The head driver 54 converts print data to drive signals to drive each heating element 24 of the thermal head 20.

A motor driver 56 and a lamp driver 57 are connected to the system controller 41. In response to a control signal from the system controller 41, the motor driver 56 generates drive pulses to drive the convey motor 16. The convey motor 16 is a step motor. The system controller 41 counts the drive pulse to detect the conveyance amount of the color thermosensitive recording paper 10. In response to a control signal from the system controller 41, the lamp driver 57 lights on and lights off the yellow fixation lamp 35 and the magenta fixation lamp 36 to fix the yellow thermosensitive coloring layer and the magenta thermosensitive coloring layer respectively.

A data memory 64 is connected to the system controller 41 and the lateral edge sensors 27 and 28. The data memory 64 stores lateral edge position data, in other words, position data of the lateral edge 10*a* of the color thermosensitive recording paper 10 in the main scan direction. Lateral edge position data is read from the data memory 64 upon image recording and inputted into the system controller 41.

Figure 4:
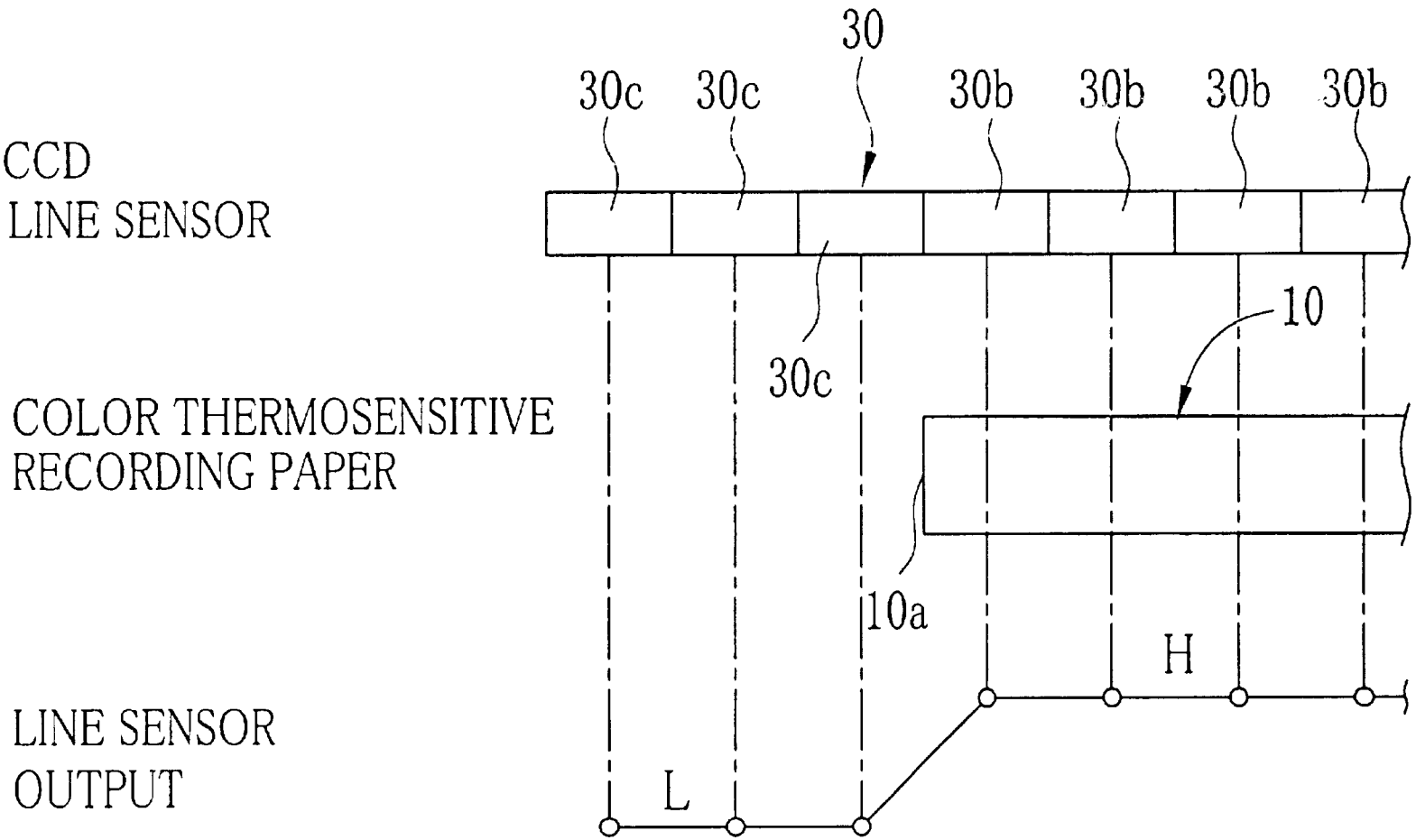
FIG. 4 is an explanatory view illustrating the change of an output signal level from each pixel of a CCD line sensor.

Output signal level from each pixel of the CCD line sensor 30 is changed upon imaging the lateral edge 10*a* of the color thermosensitive recording paper 10, as shown in FIG. 4. The pixel 30*b* that faces the color thermosensitive recording paper 10 outputs signals of H level. Meanwhile the pixel 30*c* that does not face thereof outputs signals of L level. By detecting the difference in the output signal level, position of the lateral edge 10*a* of the color thermosensitive recording paper 10 is decided by a pixel unit.

Figure 5:
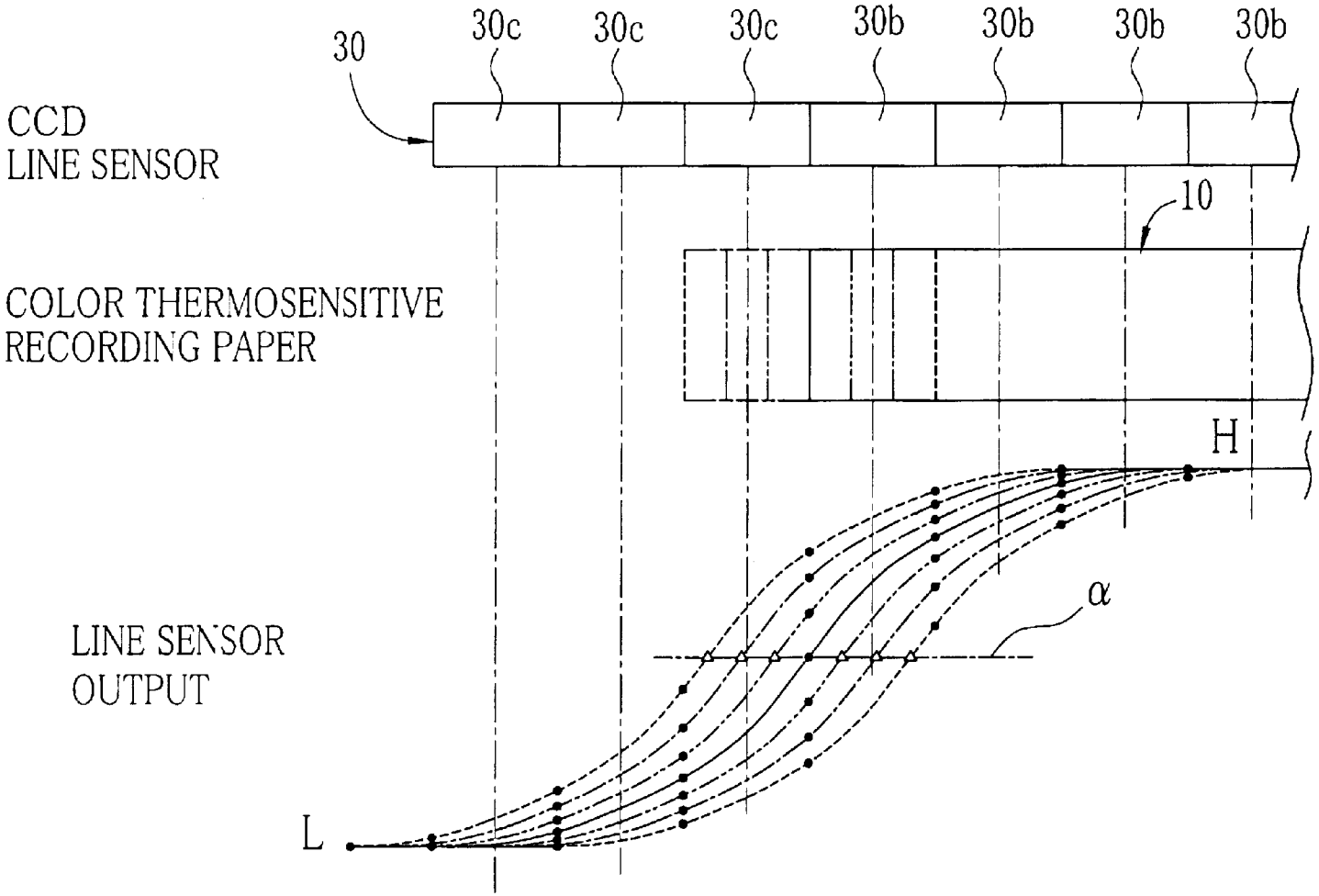
FIG. 5 is an explanatory view illustrating the change of the output signal level from each pixel in detail.

As a matter of fact, however, the CCD line sensor 30 outputs signals between L level and H level because of analog signal output. Moreover, each pixel 30*b*, 30*c* of the CCD line sensor 30 images not only the part facing the color thermosensitive recording paper 10, but also the adjacent part. Accordingly, output signal levels from the pixels 30*b*, 30*c* are not linearly changed, as shown in FIG. 5. An output level curve is obtained by interpolating the output signal levels from each pixel 30*b*, 30*c* (black dots). When the lateral edge 10*a* of the color thermosensitive recording paper 10 is shifted to the position shown by a two-chain line, a chain line, and a broken line in the drawing, the output level curve is also shifted to the position shown by two-chain lines, chain lines, and broken lines, respectively.

The position of the lateral edge 10*a* is detected more precisely by use of the output level curve. The lateral edge position is detected by calculating intersection points (white triangles) of a threshold level $\alpha$ (for instance, the middle level between L level and H level) and the output level curve.

Figure 6:
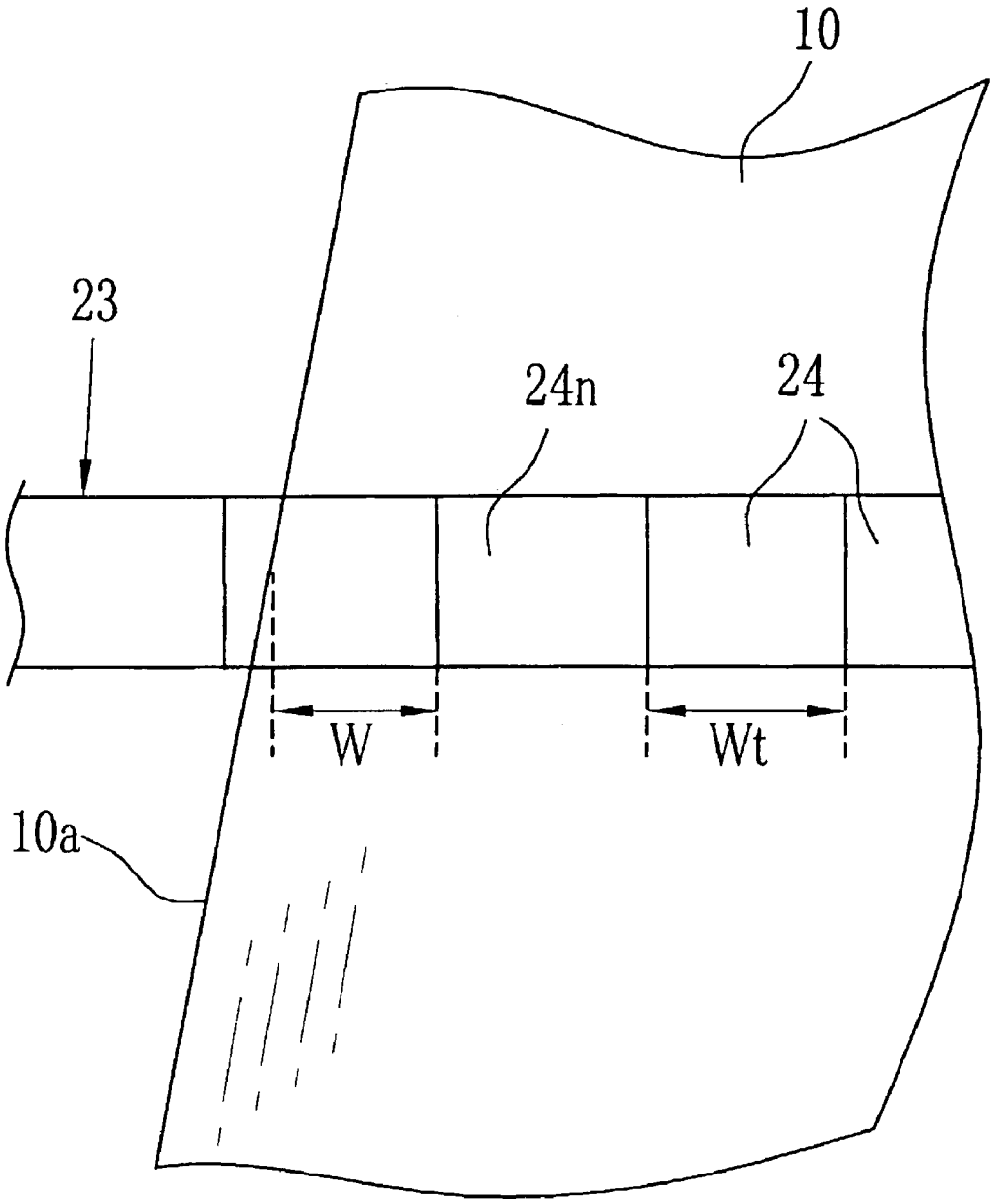
FIG. 6 is an enlarged top plan view illustrating the lateral edge of the recording paper and the heating element array.

The system controller 41 obtains the output level curve, and detects the lateral edge position 10*a* of the color thermosensitive recording paper 10. The system controller 41 specifies an edge heating element 24*n* that is closest to the lateral edge 10*a* among the heating elements 24 with the whole pixel in the color thermosensitive recording paper 10. As shown in FIG. 6, the distance W between the lateral edge of the edge heating element 24*n* and the lateral edge 10*a* of the color thermosensitive recording paper 10 is calculated. The system controller 41 calculates the percentage of the distance W in the width Wt of the heating element 24. As a result, coloring density of the edge heating element 24*n* is determined depending on the percentage of the distance W.

Figure 7:
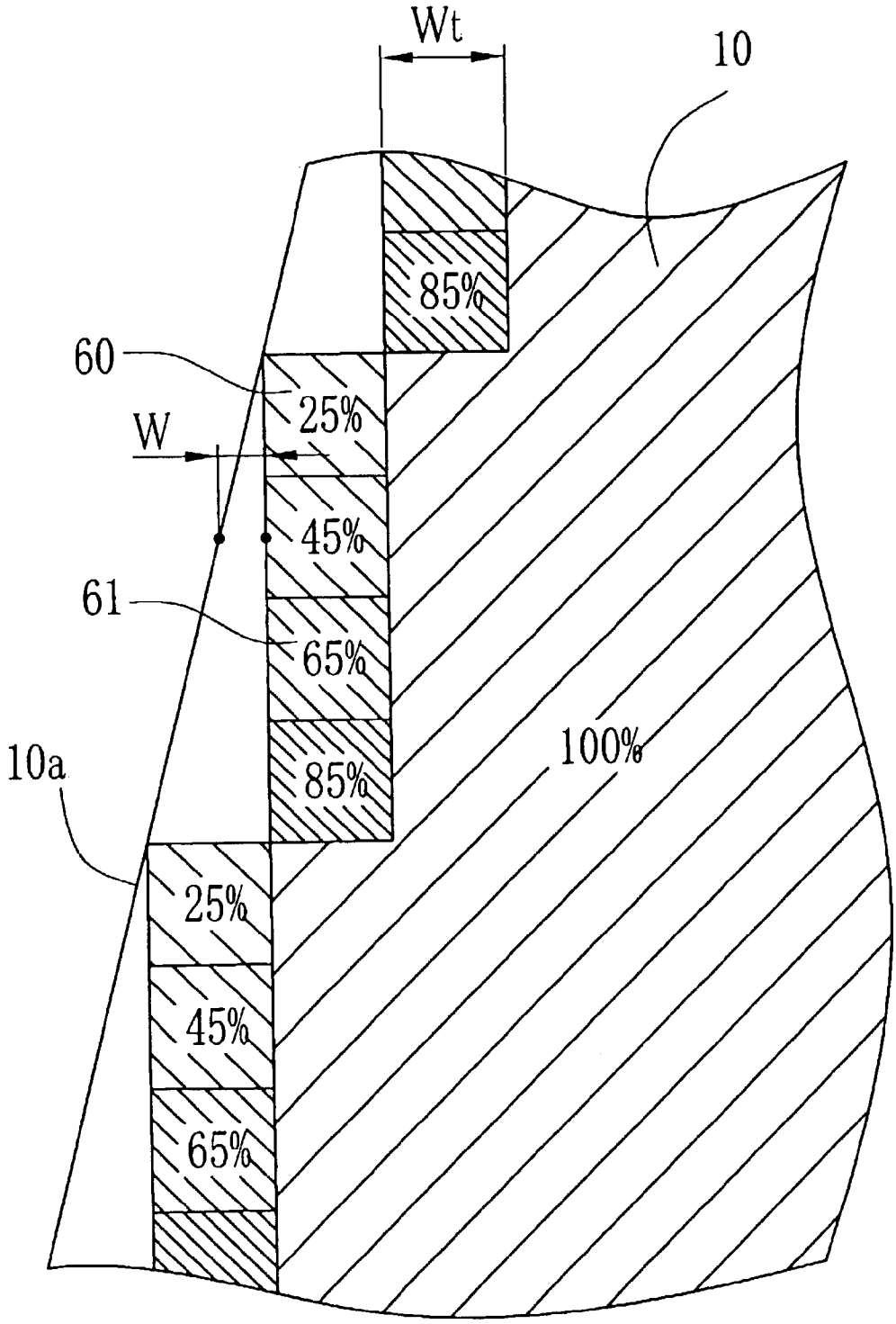
FIG. 7 is an explanatory view illustrating an example to control density of a pixel adjacent to the lateral edge.

For example, as shown in FIG. 7, when the distance W from a pixel corresponding to the edge heating element 24*n* (a pixel 60 in this case) to the lateral edge 10*a* accounts for 25% of the width Wt, the system controller 41 controls the edge heating element 24*n* to record the pixel 60 at 25% of the printing density. Similarly, in case the distance W from a pixel 61 to the lateral edge 10*a* accounts for 65% of the width Wt, the system controller 41 controls the edge heating element 24*n* to record the pixel 61 at 65% of the printing density. This shades off the boundary between approximately triangular blank areas and the lateral edge of the print image, regardless of jaggy occurred by the tilt conveyance of the color thermosensitive recording paper 10. The recording density of the edge heating element 24*n* is controlled to both lateral edges of the color thermosensitive recording paper 10.

The operation of the above embodiment of the present invention is described. The memory controller 43 reads image data stored in the memory card 47. The image output circuit 51 displays the image on the monitor 50. A user selects an image displayed on the monitor 50 for printing. When print command is inputted, the system controller 41 drives the convey motor 16 to rotate the paper supply roller 12 counterclockwise in FIG. 1. The leading edge of the color thermosensitive recording paper 10 is fed toward the conveyance path.

The leading edge sensor 25 sends inspection signals to the system controller 41 when the leading edge of the color thermosensitive recording paper 10 passes the leading edge sensor 25. In response to the inspection signals from the leading edge sensor 25, the system controller 41 starts counting the drive pulse inputted from the motor driver 56 to the convey motor 16 in order to specify the conveyance amount of the color thermosensitive recording paper 10.

When a printing start position (first line) 10*c* in a recording area 10*b* (hatching area in the FIG. 2) reaches the detecting position of the lateral edge sensors 27 and 28, the system controller 41 stops rotating the convey motor 16 to complete paper supply. The pinch roller 18 is moved by a shift mechanism (not shown) to cooperate with the capstan roller 17 to nip the color thermosensitive recording paper 10. Similarly, the platen roller 21 is moved by a shift mechanism (not shown) to cooperate with the heating element array 23 to nip the color thermosensitive recording paper 10.

Figure 8:
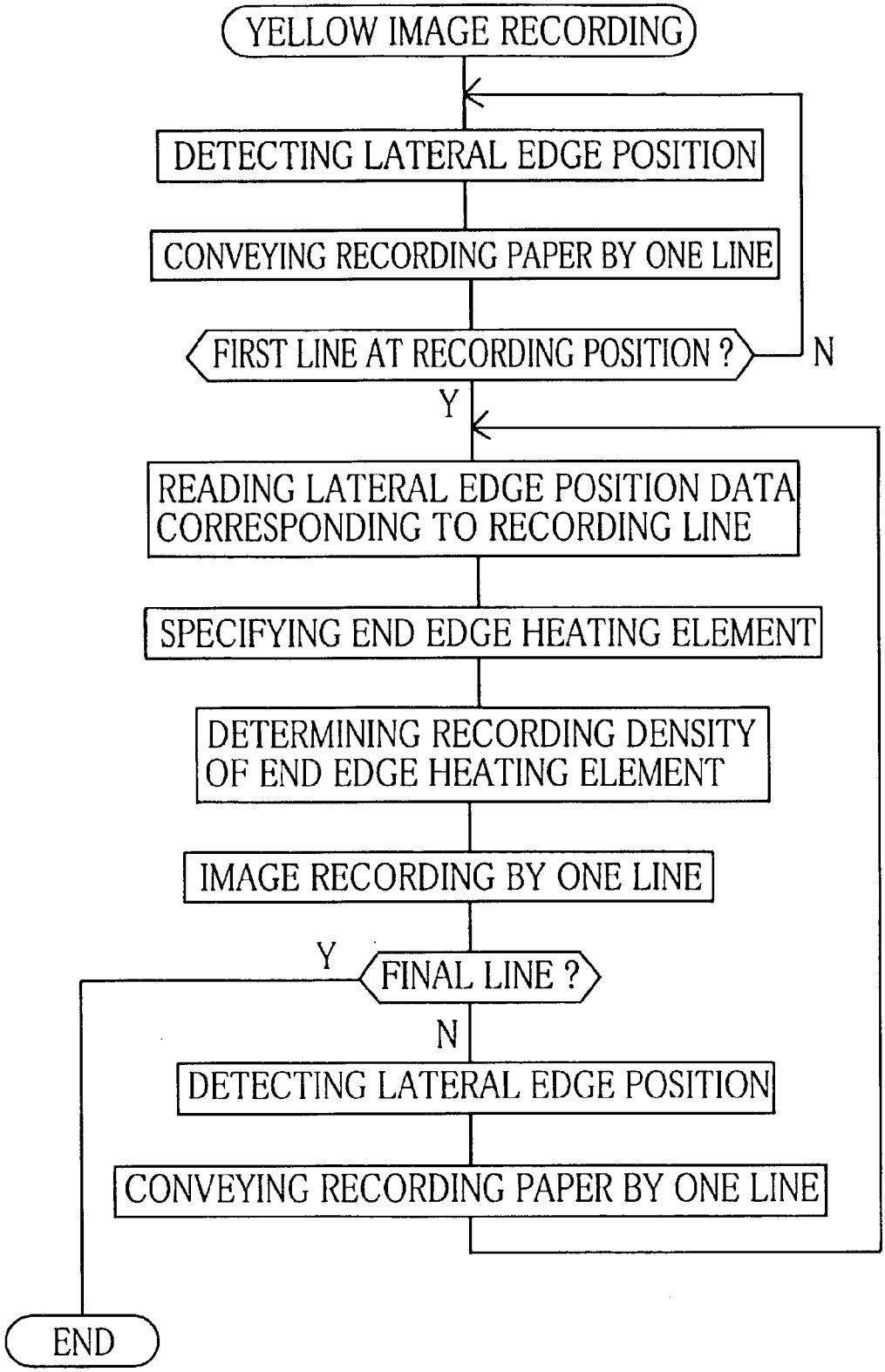
FIG. 8 is a flow chart illustrating a recording process of yellow image.
Figure 9:
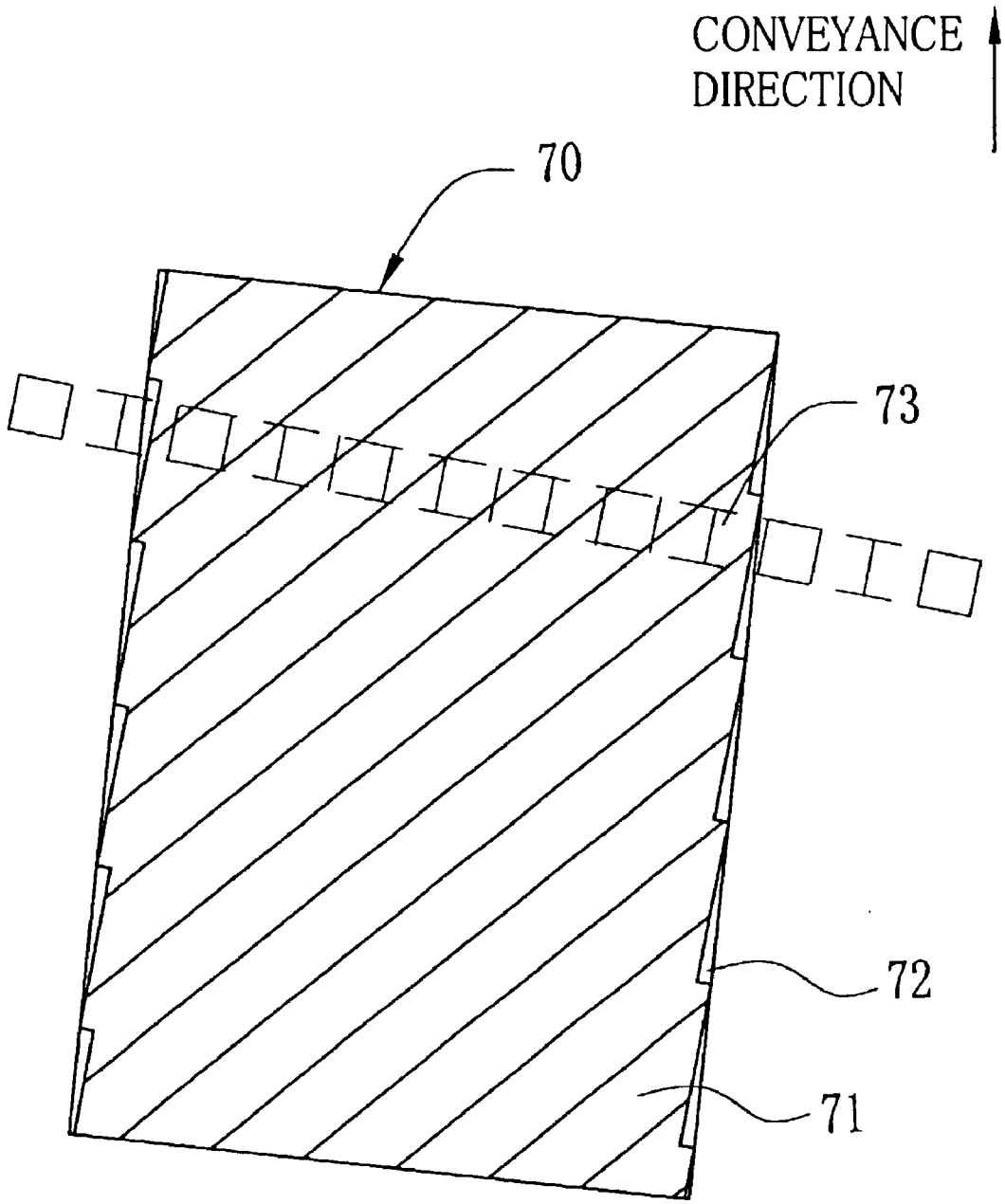
FIG.9 (PRIOR ART)
FIG. 9 is an explanatory view illustrating jaggy areas on both lateral edges of a printing image.

In accordance with the flow chart shown in FIG. 8, the system controller 41 prints yellow image on the color thermosensitive recording paper 10. The system controller drives the edge detecting sensors 27 and 28 to detect the lateral edge position corresponding to the first line 10*c*. The information of the lateral edge position is stored in the data memory 64 as lateral edge position data. While moving the color thermosensitive recording paper 10 in the rewind direction for each line, the system controller 41 detects the lateral edge position corresponding to each line. Lateral edge position data corresponding to each line is stored in the data memory 64.

When the first line 10*c* reaches the recording position, the system controller 41 reads out lateral position data corresponding to the first line 10*c* from the data memory 64. The system controller 41 specifies the edge heating element 24*n* to calculate the distance W. Further, the system controller 41 decides the recording density of the edge heating element 24*n* to decrease the coloring density in accordance with the percentage of the distance W in the width Wt of the heating element 24. The system controller 41 drives the heating element 24 including the edge heating element 24*n* to record yellow image of first line on the color thermosensitive recording paper 10.

When the first line is recorded, the system controller 41 conveys the color thermosensitive recording paper 10 in the rewind direction by one line. Lateral edge position data correspnding to the second line is read out of the data memory 64 to adjust the recording density of the edge heating element 24*n*. The second line is recorded in the same way as recording the first line. In this way, yellow image is recorded in the recording area 10*b* line by line. When the last line is recorded, the platen roller 26 releases the color thermosensitive recording paper 10. Further, the system controller 41 stops driving the heating element array 23 to complete recording yellow image.

The convey roller pairs 15 is driven to convey the color thermosensitive recording paper 10 in the wind direction. At the same time, the yellow fixatin lamp 35 is turned on to fix the yellow thermosensitive coloring layer. Upon completion of fixation, the system controller 41 lights off the yellow fixation lamp 35 and conveys the color thermosensitive recording paper 10 in the rewind direction. When the first line 10*c* of the recording area 10*b* reaches the detecting position by the edge sensors 27 and 28, the lateral edge sensors 27 and 28 detect the lateral edge position of the color thermosensitive recording paper 10.

In the same way as recording yellow image, magenta image is recorded on the color thermosensitive recording paper 10. The system controller 41 reads lateral edge position data from the data memory 64 and decides the coloring density of the edge heating element 24*n*. Magenta image is recorded line by line. Upon completion of recording of magenta image, the system controller 41 conveys the color thermosensitive recording paper 10 in the wind direction and lights on the magenta fixation lamp 36 to fix the printed magenta thermosensitive coloring layer. Similarly, cyan image is printed to form a full-color image on the color thermosensitive recording paper 10. After image recording, the color thermosensitive recording paper 10 is conveyed in the wind direction and cut to a cut sheet with a predetermined length. The cut sheet is ejected from the paper outlet 39 outside the color thermosensitive printer.

According to the above embodiment, the lateral edge sensors 27 and 28 are driven to detect lateral edge position on recording magenta and cyan image. However, it is possible to omit this process. That is, lateral edge position data obtained in yellow image recording is used to specify the edge heating element 24*n*. Reducing the recording density of the edge end heating element 24*n* improves image quality.

Besides that, the CCD line sensors and the LEDs may be disposed to face each other across the conveyance path of the color thermosensitive recording paper although they are integrally formed in the above embodiment. It is also possible to provide the CCD line sensor and the LED only on one lateral side of the conveyance path.

In addition to a color thermosensitive printer, it is possible to apply the present invention to various printers, such as a monochrome thermosensitive printer, thermosensitive printers of sublimation type and heat melting type, an ink jet printer, a laser printer, a light printer and so forth.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer having a recording head with plural recording elements being arranged in a main scan direction to record pixels on a recording paper, said recording head recording an image line by line while conveying said recording paper in a sub scan direction, said printer comprising:

a sensor for detecting a lateral edge position of said recording paper in said main scan direction:

a detecting section for detecting an edge recording element that is closest to said lateral edge position among said recording elements with the whole pixel in said recording paper; and a record control section for controlling said edge recording elements so as to decrease the recording density of an edge pixel corresponding to said edge heating element.

2. A printer as claimed in claim 1, wherein said sensor is a CCD line sensor on which plural pixels are arranged along said main scan direction, said detecting section detects said lateral edge position by the change of output signal levels from said pixels of said CCD line sensor.

3. A printer as claimed in claim 2, wherein said pixels of said CCD line sensor are arranged at the same pitch as said recording elements.

4. A printer as claimed in claim 2, wherein said detecting section interpolates output signal level from said pixels of said CCD line sensor to obtain an output level curve with respect to said main scan direction, said detecting section deciding said lateral edge position in which said output level curve takes a set value.

5. A printer as claimed in claim 4, wherein said record control section calculates a control value that is the proportion of the distance between said lateral edge position and said edge recording element in said main scan direction to the interval of adjacent said recording elements, said record control section adjusting the recording density of said edge pixel in accordance with said control value.

6. A printer as claimed in claim 5, wherein said record control section determines said recording density of said edge pixel by multiplying said control value by density of said image corresponding to said edge pixel.

7. A printer as claimed in claim 2, further comprising:

a memory for recording lateral edge position data indicating said lateral edge position, said detecting section detecting said lateral edge position each time said recording paper being conveyed by one line and storing said lateral edge position data and corresponding line number data into said memory.

8. A printing method having a recording head with plural recording elements to record pixels on a recording paper, said recording elements being arranged in a main scan direction for recording an image line by line while conveying said recording paper in a sub scan direction, said printing method comprising the steps of:

detecting a lateral edge position of said recording paper in said main scan direction;

detecting an edge recording element that is closest to said lateral edge position among said recording elements with the whole pixel in said recording paper; and controlling said edge recording element so as to reduce the recording density of an edge pixel corresponding to said edge recording element.

9. A printing method of claim 8, further comprising the steps of:

driving a CCD line sensor with plural pixels being arranged in said main scan direction;

detecting output signal level from said pixels of said CCD line sensor; and detecting said lateral edge position by the change of said output signal level.

10. A printing method of claim 9, further comprising steps of:

forming an output level curve to said main scan direction by interpolating said output signal level from said pixels of said CCD line sensor; and determining said lateral edge position in which said output level curve takes a set value.

11. A printing method of claim 10, further comprising steps of:

calculating a control value that is the proportion of the distance in said main scan direction between said lateral edge position and said edge recording element to the interval of adjacent said recording element as a control value; and controlling the recording density of said edge pixel in accordance with said control value.

12. A printing method of claim 11, wherein said recording density of said edge pixel is determined by multiplying said control value by density of said image that corresponds to said edge pixel.

* * * * *